US008631670B2

(12) United States Patent
Sieglaar et al.

(10) Patent No.: US 8,631,670 B2
(45) Date of Patent: Jan. 21, 2014

(54) LOCK

(75) Inventors: Edward Norton Sieglaar, Waitakere (NZ); Peter Mark Hill, Waitakere (NZ)

(73) Assignee: Ingersoll-Rand Architectural Hardware Limited, Auckland (NZ)

( * ) Notice: Subject to any disclaimer, the term of this patent is extended or adjusted under 35 U.S.C. 154(b) by 163 days.

(21) Appl. No.: 13/139,001

(22) PCT Filed: Dec. 10, 2009

(86) PCT No.: PCT/NZ2009/000283
§ 371 (c)(1),
(2), (4) Date: Aug. 29, 2011

(87) PCT Pub. No.: WO2010/068123
PCT Pub. Date: Jun. 17, 2010

(65) Prior Publication Data

US 2011/0296880 A1 Dec. 8, 2011

(30) Foreign Application Priority Data

Dec. 10, 2008 (NZ) ..... 573537

(51) Int. Cl.
*E05B 65/08* (2006.01)

(52) U.S. Cl.
USPC ..... 70/100; 70/137; 70/472

(58) Field of Classification Search
USPC ..... 70/95–100, 135–137, 139, 472
See application file for complete search history.

(56) References Cited

U.S. PATENT DOCUMENTS

| | | | | |
|---|---|---|---|---|
| 1,380,116 | A | 5/1921 | Solaini | |
| 5,447,047 | A * | 9/1995 | Lin | 70/218 |
| 5,951,068 | A | 9/1999 | Strong et al. | |
| 6,487,884 | B1 * | 12/2002 | Constantinou | 70/277 |
| 6,502,435 | B2 * | 1/2003 | Watts et al. | 70/95 |
| 6,748,773 | B2 | 6/2004 | Alchin et al. | |

(Continued)

FOREIGN PATENT DOCUMENTS

| | | | |
|---|---|---|---|
| AU | 200068085 | A1 | 6/2002 |
| WO | 02/48486 | | 6/2002 |
| WO | 2004/022891 | A1 | 3/2004 |
| WO | 2009000013 | | 12/2008 |

OTHER PUBLICATIONS

PCT/NZ2009/000283 International Search Report and Written Opinion.

*Primary Examiner* — Christopher Boswell
(74) *Attorney, Agent, or Firm* — Michael Best & Friedrich LLP

(57) ABSTRACT

A lock for a sliding door or window including a latching linkage and an inner manual lever, that allows movement of the latching linkage between a locked and an unlocked position by means of the manual lever and by operation of a inside or outside key barrel, but also allows deadlocking of the latching linkage in its locked position so that operation of the manual lever to unlock the latching linkage is prevented. It is however, desirable that the lock be operable to lock the lock from the inside by a convenient operation of the manual lever when the user is inside the house. It is further desirable that the door is able to be deadlocked by a key from the inside or the outside in a manner that prevents unlocking of the door by the manual handle, since a house owner may find it inconvenient to have to walk around the outside of their house locking the doors.

45 Claims, 6 Drawing Sheets

(56) References Cited

U.S. PATENT DOCUMENTS 7,228,719 B2 * 6/2007 Alchin et al. ..... 70/84
7,418,845 B2 * 9/2008 Timothy ..... 70/100
2002/0017120 A1 2/2002 Watts et al.

* cited by examiner

LOCK

TECHNICAL FIELD

The present invention relates to a lock for a sliding barrier. More particularly but not exclusively it relates to a lock for a sliding barrier such a sliding door or a sliding window which may be locked by a key and/or snib.

BACKGROUND OF THE INVENTION

Sliding window locks and door locks are well known. Such a lock can include a housing and pair of counter-rotating latches that rotate from a position inside the housing to engage with a strike located on the frame of the door or window on which they are installed. Such locks may be operable by means of a key to lock the door from the outside, especially where the lock is installed on a door.

Such a lock can include a manual snib or lever disposed towards the inside of the door. Such a lever allows a user to manually lock or unlock the lock once it has been locked by a key, regardless of whether the lock has been locked by the key from the outside or the inside.

However, it may not always be desirable for the door to be unlockable in this manner. For instance, a home owner may desire that the door remain locked once it has been locked by a key, so that it can only be unlocked by a user having that key. An example of such a situation is where a user is leaving their home locked while going on holiday. It would be undesirable for a burglar to be able to enter the house and unlock the door from the inside by means of the inside manual lever, thereby allowing free movement of the burglar to and from the house. In such a situation, it would be preferable that the door remain deadlocked until unlocked by a key.

It is however, desirable that the lock be operable to lock the lock from the inside by a convenient operation of the manual lever when the user is inside the house.

It is further desirable that the door is able to be deadlocked by a key from the inside or the outside in a manner that prevents unlocking of the door by the manual handle, since a house owner may find it inconvenient to have to walk around the outside of their house locking the doors.

It is further desirable that any lock that addresses the issues above be reliable in operation, and compact in construction.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

OBJECT OF THE INVENTION

It is an object of the present invention to provide a lock which overcomes or at least ameliorates some of the above-mentioned disadvantages or addresses at least some of the desiderata, or which at least provides the public with a useful choice.

SUMMARY OF THE INVENTION

According to a first aspect, the present invention is a lock suitable for a sliding barrier, said lock comprising

- a housing
- a latch linkage moveable between

- a locked position in which at least part of the latch linkage extends from the housing for engagement with a strike, and
  - an unlocked position in which the latch linkage is at least partly retracted into the housing;
- a locking assembly comprising
  - a moveable base member, said base member being coupled to the latch linkage to move between
    - a first position in which the latch linkage is in a locked position, and
    - a second position in which the latch linkage is in its unlocked position,
  - a locking arrangement configured and adapted to be actuated for movement between
    - a locking position when the base member is in its first position, and in which the base member is prevented from moving relative the housing, and
    - a free position wherein the locking arrangement does not prevent movement of the base member;
  - a manual lever associated with the base member, said lever being manually operable by a user to move the base member between its first position and second position, thereby moving the latch linkage between its locked and unlocked position respectively;
  - an engaging member,
    - said engaging member configured and adapted to be movable by at least one actuator;
    - said engaging member being associated with the base member to move relative to it in a lost motion manner to move the base member between its first position and second position,
    - wherein the lost motion movement by the engaging member relative to the base member is between
      - an engaged configuration, and
      - an unengaged configuration;
    - said engaging member including an actuating formation which is configured and adapted to engage with the locking arrangement to actuate it to its locking position when the configuration of the base member and the engaging member is in an engaged configuration and the base member is in its first position, thereby deadlocking the base member against movement by operation of the manual lever.

Preferably, the movement of the engaging member by an actuator to lock the lock first causes movement of the base member to its first position before causing relative movement between the engaging member and the base member.

Preferably the effect of the movement of the engaging member by an actuator first causing movement of the base member to its first position before causing relative movement between the engaging member and the base member is caused by the actuating formation engaging with a locating formation on the base member to hold the base member and the engaging member together.

Preferably, the movement of the engaging member by an actuator to unlock the lock first causes relative movement of the engaging member and base member to their unengaged configuration to allow movement of the locking arrangement to its free position before causing movement of the base member to its second position.

Preferably the effect of the movement of the engaging member by an actuator to unlock the lock first causing relative movement of the engaging member and base member to their unengaged configuration to allow movement of the locking arrangement to its free position before causing movement of the base member to its second position is caused by relative movement between the base member and the engaging member to cause the actuating formation to disengage with the locking arrangement before moving into engagement with a locating formation, after which the base member and engaging member are held together to cause movement of the base member to its second position.

Preferably, the lost motion movement between the engaging member and the base member is provided by a lost-motion formation.

Preferably, the lost motion formation is on the engaging member.

Preferably, the base member is generally cylindrical in shape.

Preferably, the base member is pivotally moveable between its first position and second position.

Preferably, both the base member and the engaging member are pivotally moveable relative to the housing.

Preferably, the lock includes a shaft.

Preferably, the shaft extends through the housing.

Preferably, the shaft is configured and adapted to be engaged with and moved by an actuator.

Preferably, the engaging member is axially moveable on the shaft.

Preferably, the engaging member is biased towards the base member.

Preferably, the engaging member is biased towards the base member by a biasing means.

Preferably, the biasing means is a spring.

Preferably, the spring is located on the shaft by a circlip and washer arrangement.

Preferably, the base member and engaging member are mounted on a shaft.

Preferably, the base member is rotatably mounted on the shaft.

Preferably, the engaging member is mounted on the shaft in a non-pivotable fashion.

Preferably the engaging member comprises
- a shaft engaging formation,
- a lost motion formation, and
- and actuating formation.

Preferably, the engaging member is generally configured in the form of a washer.

Preferably, the actuating formation is in the form of cam formations extending from the washer.

Preferably, the shaft engaging formation is an aperture or recess.

Preferably the aperture or recess includes at least one flat side.

Preferably, the lost motion formation is a recess in the engaging member.

Preferably the lost motion formation is engageable with an engaging formation on the base member in a manner to induce lost motion movement.

Preferably, the pivoting engaging member is coaxial with and abutting an end of the base member adjacent the engaging formation.

Preferably, the latch linkage comprises
- at least one sliding member coupled to the base member
- at least one latch member coupled to the sliding member to be pivoted by sliding movement of the sliding member to move pivotally between
  - a locked position and
  - an unlocked position.

Preferably, the latch linkage comprises plurality of sliding members and a plurality of latch members.

Preferably, the locking arrangement includes at least one passage in the base member, into which
- a locking pin is slidingly received, said locking pin being slidingly moveable between
  - a locking position in which it extends from the base member into locking formations on the housing, to prevent movement of the base member, and
  - a free position, in which the locking pin is retracted from the locking formations, to allow movement of the base member Preferably, the locking pin and passage are substantially axially oriented with respect to the base member.

Preferably, the lock includes an anti-slam mechanism for preventing movement of the latch linkage from an unlocked position to a locked position unless the housing is in close proximity to a door frame.

Preferably, the anti-slam mechanism acts on the base member to prevent movement of the latch linkage from an unlocked position to a locked position unless the housing is in close proximity to a door frame.

Preferably, the anti-slam mechanism comprises
- a depressable member moveable between
  - an extended position and
  - a depressed position, and
- a locking formation which is engageable with the base member when the depressable member is in its extended position to prevent movement of the base member.

Preferably, the engaging member is engageable for movement by a plurality of actuators.

Preferably, the engaging member is engageable for movement by a plurality of actuators.

Preferably, the engaging member is engageable for movement by a pair of actuators, each one located at opposing sides of the housing.

Preferably, each of the pair of actuators is engageable with the shaft, which in turn engages the engaging member to rotate it.

Preferably, the lock includes at least one or more actuators.

Preferably, at least one of the actuators are key barrels.

Preferably, the housing is adapted to be secured to an outer major face of a sliding barrier.

Preferably, the latch member is configured to pivot outwardly from the housing about an axis perpendicular to the major face of the sliding barrier.

According to a another aspect, the present invention is a lock arrangement for a sliding barrier, said lock arrangement comprising
- a housing
- a latch linkage moveable between
- a locked position in which at least part of the latch linkage extends from the housing for engagement with a strike, and
- an unlocked position in which the latch linkage is at least partly retracted into the housing;
- a locking assembly comprising
  - a moveable base member, said base member being coupled to the latch linkage to move between
    - a first position in which the latch linkage is in a locked position, and
    - a second position in which the latch linkage is in its unlocked position,
  - a locking arrangement configured and adapted to be prevent movement of the latching mechanism by the manual lever
  - a manual lever extending from the base member, said lever being manually operable by a user to move the base member between its first position and second position, thereby moving the latch linkage between its locked and unlocked position respectively;

an engaging member, said engaging member movable by at least one actuator;

said engaging member being moveable relative to the base member between an engaged configuration, and an unengaged configuration;

wherein movement of the latch linkage by the manual lever is prevented by the locking arrangement when the engaging member and base member are in their engaged configuration.

Preferably, the movement of the latch linkage by the manual lever is rigidly locked when the engaging member and base member are in their engaged configuration.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention will now be described by way of example only and with reference to the drawings in which.

DETAILED DESCRIPTION OF THE PREFERRED EMBODIMENT(S)

Figure 1:
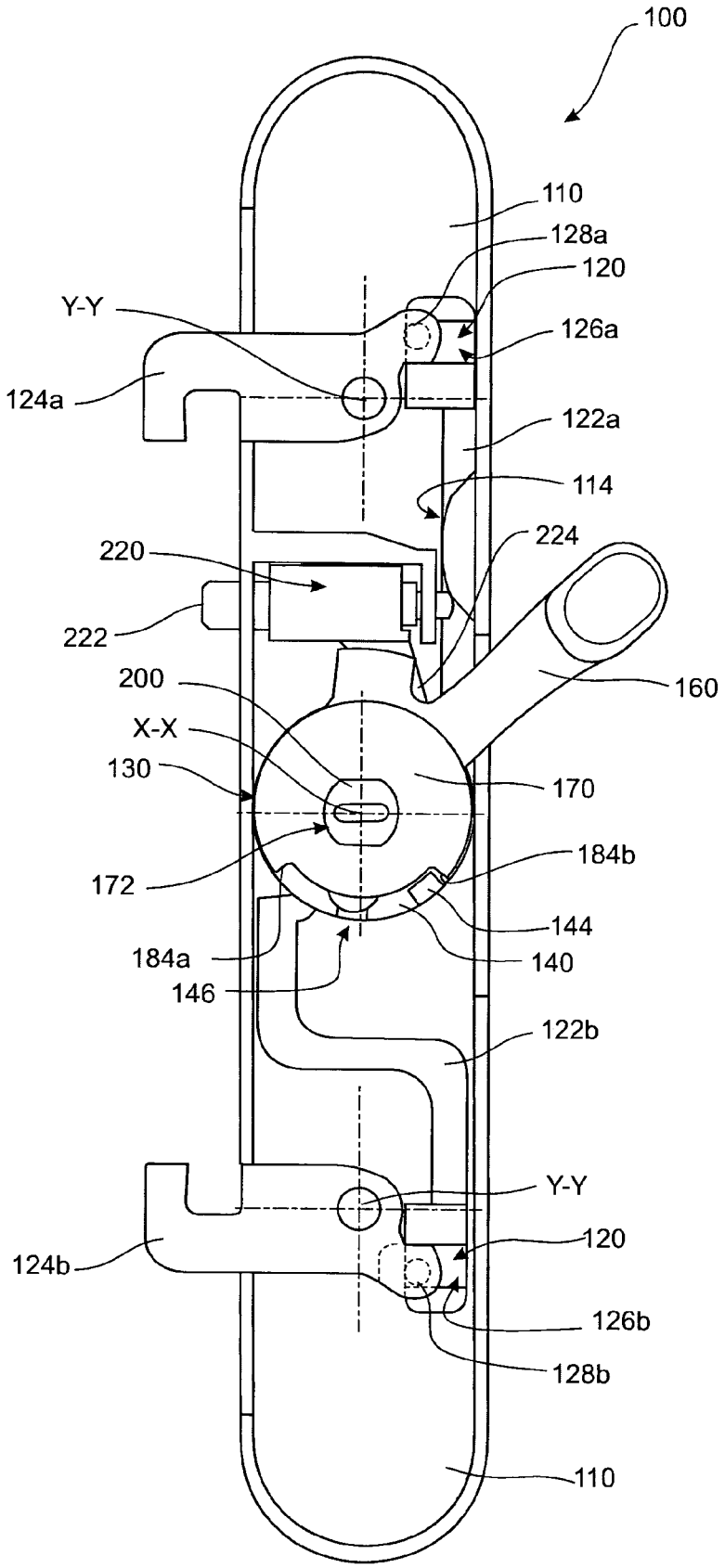
FIG. 1: shows a cutaway front view of a lock with its latch linkage in the locked position.

With reference to the above drawings, in which similar features are generally indicated by similar numerals, a locking mechanism or lock according to a first aspect of the invention is generally indicated by the numeral 100.

In one embodiment now described, there is provided a lock 100, suitable for a barrier such as a sliding door. The lock 100 comprises a housing 110, a latch linkage 120, and a locking assembly 130. The housing 110 generally holds and houses both the latch linkage 120 and the locking assembly 130.

The latch linkage 120 comprises a pair of sliding members 122 *a&b* coupled to a pair of latch members 124 *a&b*. The latch linkage 120 is moveable between a locked position in which at least part of the latch linkage extends from the housing for engagement with a strike and an unlocked position in which the latch linkage is at least partly retracted into the housing. The sliding members 122 *a&b* are slidably mounted relative to the housing 110. For example sliding member 122*a* is located partially in a channel 114 in the housing 110.

The latch linkage 120 also includes latch members 124 *a&b* associated with and coupled to each sliding member 122 *a&b* respectively. The latch members 124 *a&b* are each pivotable about their own axis Y-Y on axle pins 125 *a&b* between a locked position and an unlocked position. The locked and unlocked positions of the latch members 124 *a&b* correspond to the locked position and unlocked position of the latch linkage 120 respectively. The sliding members 122 *a&b* and latch member 124 *a&b* are coupled to each other by means of lugs 128 *a&b* that extend from under the latch member 124 *a&b* into complementary slots 126 *a&b* in the sliding members 122 *a&b*, so that sliding movement of the sliding members 122 *a&b* results in pivoting movement of the latch member 124 *a&b* about respective axes Y-Y.

Figure 2:
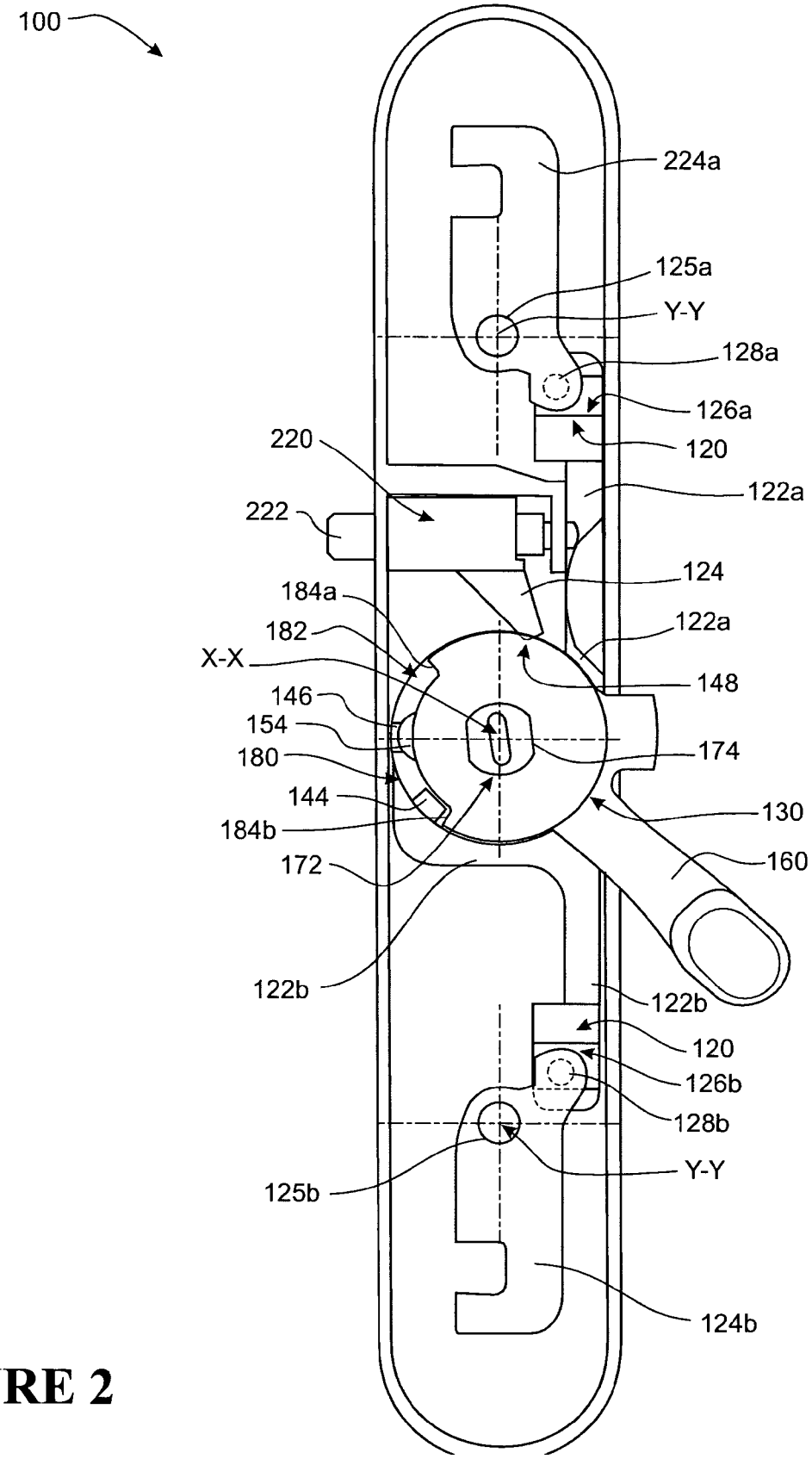
FIG. 2: shows a cutaway front view of a lock with the latch linkage in the unlocked position.

In this way, the latch linkage 120 is moveable between a locked position (as shown in FIG. 1) in which the latch members 124 *a&b* extend from the housing 110 for engagement with an adjacent strike (not shown) on a door frame (not shown), and an unlocked position (as shown in FIG. 2) in which the latch members 124 *a&b* are retracted preferably completely back into the housing 110.

The locking assembly 130 comprises a pivotally moveable cylindrically shaped base member 140, a manual lever 160 and an engaging member 170. The base member 140 is moveable pivotally between a first position (as shown in FIG. 1) and a second position (as shown in FIG. 2). The base member 140 is preferably generally cylindrical in shape. The base member 140 is pivotally moveable about axis X-X relative to said housing 110. The base member 140 is supported by the axle 200 which is mounted to the housing 110. The base member 140 is coupled to the sliding members 122 *a&b* by first lug formations 142 that are received into complementarily dimensioned slots (121 *a&b*) in the sliding members 122 *a&b*, so that pivotal movement of the base member 140 about axis X-X results in sliding movement of the sliding members 122 *a&b*, and hence pivoting movement of the latch members 124 *a&b* about their axes Y-Y. Axes X-X and Y-Y are parallel to each other. Pivotal movement of the base member 140 between its first position and second position corresponds to movement of the latch linkage 120 between its locked position and its unlocked position respectively.

Figure 4:
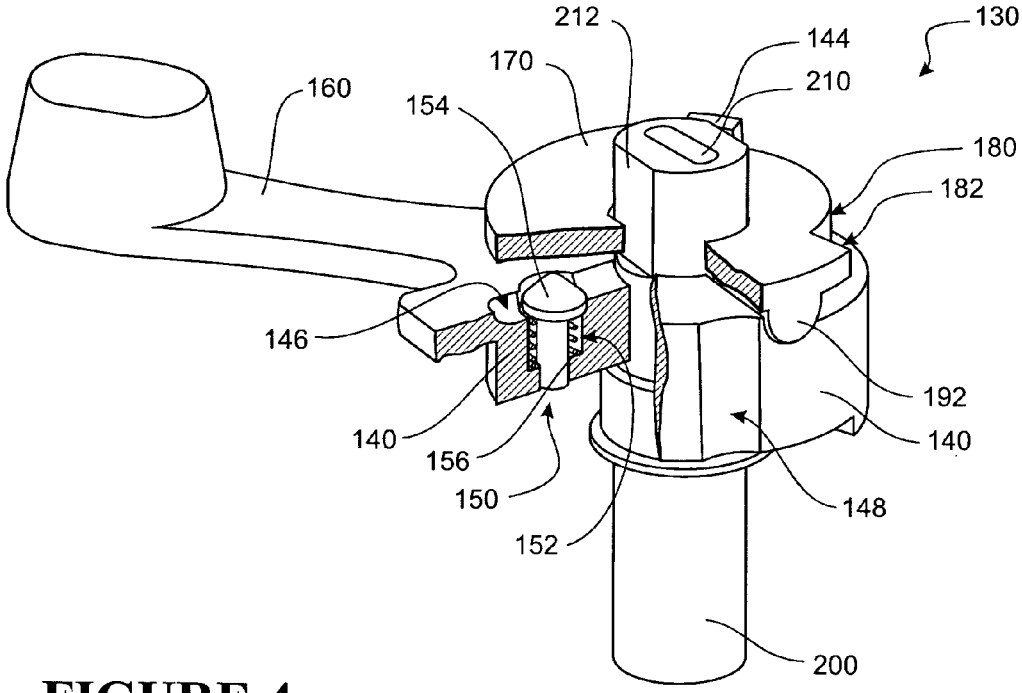
FIG. 4: shows a cutaway close up perspective view of the manual lever and locking assembly of a lock, showing the base member and engaging member in an unengaged configuration.
Figure 6:
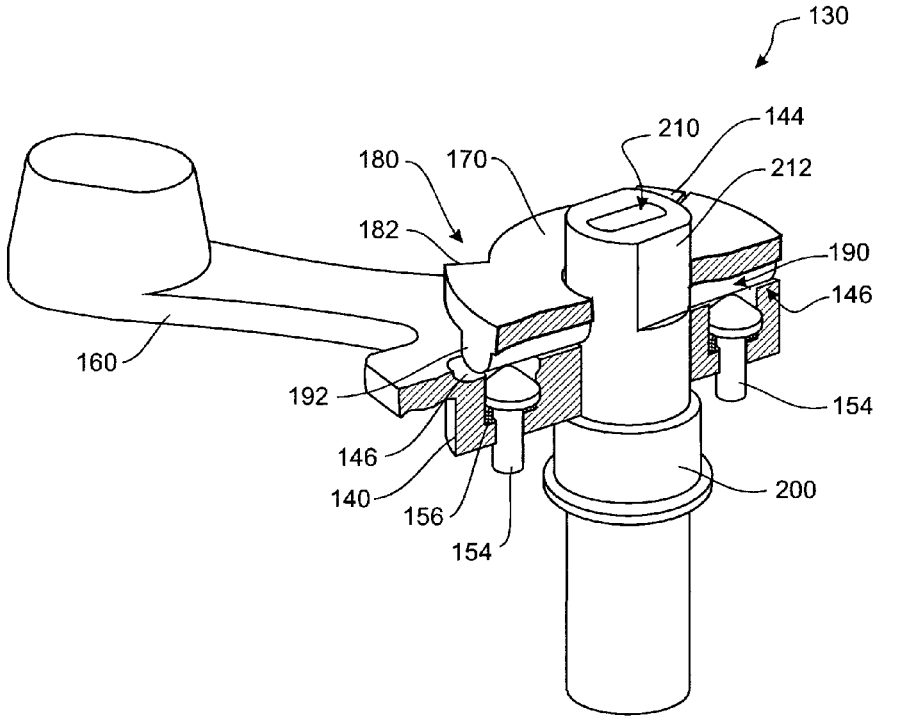
FIG. 6: shows a cutaway close up perspective view of the manual lever and locking assembly of a lock, showing the base member and engaging member in an engaged configuration.

The base member 140 also includes a locking arrangement 150. In the embodiments shown the locking arrangement 150 comprises a pair of locking pins 154, each spaced radially from axis X-X (the centre of the base member 140). Each locking pin 154 is preferably disposed on diametrically opposite sides of the preferably cylindrical body of the base member 140. The locking pins 154 are each slidingly located in respective passages 152 in the base member 140. The locking pins 154 rotate with the base member 140. When the base member 140 is in its first position, the locking pins 154 are moveable between a locking position (as shown in FIG. 6), and a free position (as shown in FIG. 4). When the base member 140 is in its first position, the locking pins 154 are in alignment with locking formations (shown in FIG. 9) 116 in the housing 110, and are moveable between a locking position in which they extend from the base member 140 to engage with the locking formations (in the form of holes 116 in the housing) and a free position in which the locking pins 154 are more retracted into the base member and do not engage with the holes 116.

When the locking pins 154 are in their locking position, and when aligned with locking formations 116 in the housing 110, they extend from the base member 150 into the locking formations (e.g. in the form of holes 116) on the housing 110. This prevents pivoting movement of the base member 140, and hence prevents movement of the latch linkage 120.

When the locking pins 154 are in their free position, the locking pins are retracted sufficiently to avoid engagement with the locking formations. The base member 140 is then freely pivotable about its axis X-X. The locking pins 154 are biased by means of a spring 156 to their free positions. The locking pins 154 can be driven towards or biased towards their locking position by the engaging member 170. This is explained below.

In this way, the locking arrangement 150 is configured and adapted to be actuated to be moved between a locking position in which the base member 140 is prevented from pivoting, and a free position in which the base member 140 is not prevented from pivoting by the locking pins 154. It should be noted that the locking arrangement 150 can only be moved to its locking position when the base member 140 is in its first position. The first position of the base member 140 corresponds to the latch members 124 *a&b* being in their locked position. Whenever the base member 140 is out of its first position, the locking pins 154 will no longer be aligned with the holes 116, and they will not be moveable to their locked position.

The base member 140 is coupled to the sliding members 122 *a&b* of the latch linkage 120 to move between a first position (as shown in FIG. 1) in which the latch member 124 *a&b* of the latch linkage 120 are in a locked position (in which the latch members 124 are extended), and in which the locking arrangement 150 is actuatable to a locking position; and a second position (as shown in FIG. 2) in which the latch linkage 120 is in its unlocked position (and in which the latch members 124 are retracted).

The locking assembly further comprises a manual lever 160 extending from the base member 140. The manual lever 160 is manually operable by a user (not shown) to move the base member 140 between its first position and second position, thereby moving the latch linkage 120 between its locked position (in which the latch members 124 are extended) and unlocked position (in which the latch members 124 are retracted) respectively.

When the base member 140 is in its first position, and the locking arrangement 150 is in its locking position (i.e. with the locking pins 154 in their locking position being received into the holes of the housing 110) then the base member will not be moveable by means of the manual lever 160. In effect, the base member 140 will be deadlocked against manual movement by the manual lever 160.

Figure 3:
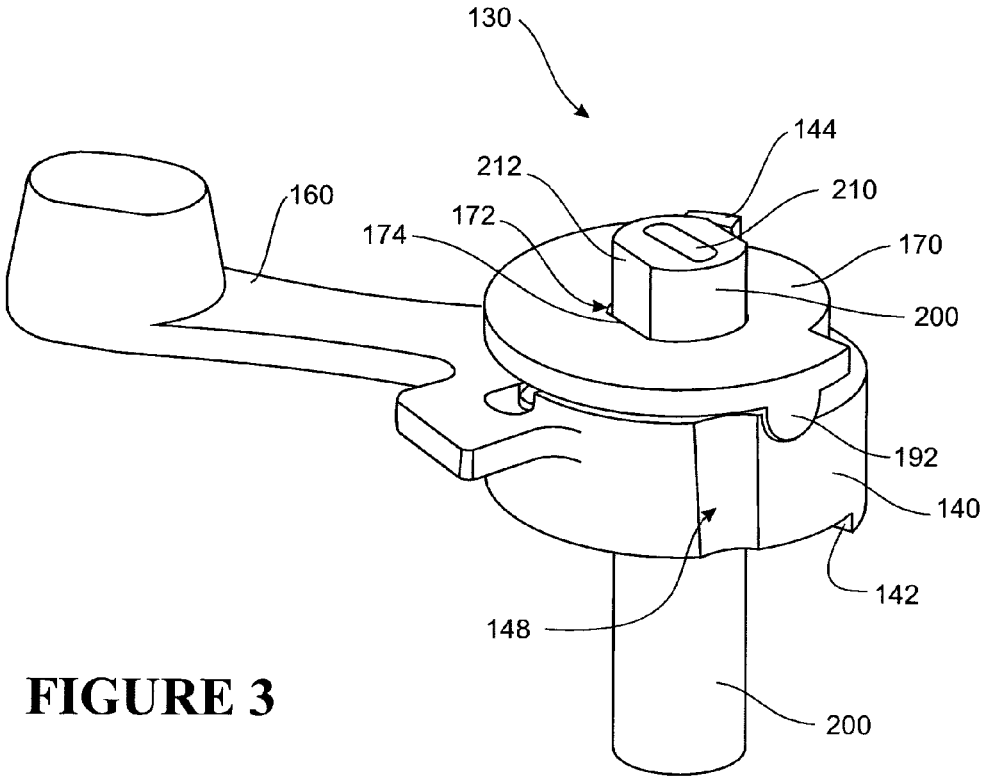
FIG. 3: shows a close up perspective view of the manual lever and locking assembly of a lock, showing the base member and engaging member in an unengaged configuration.
Figure 9:
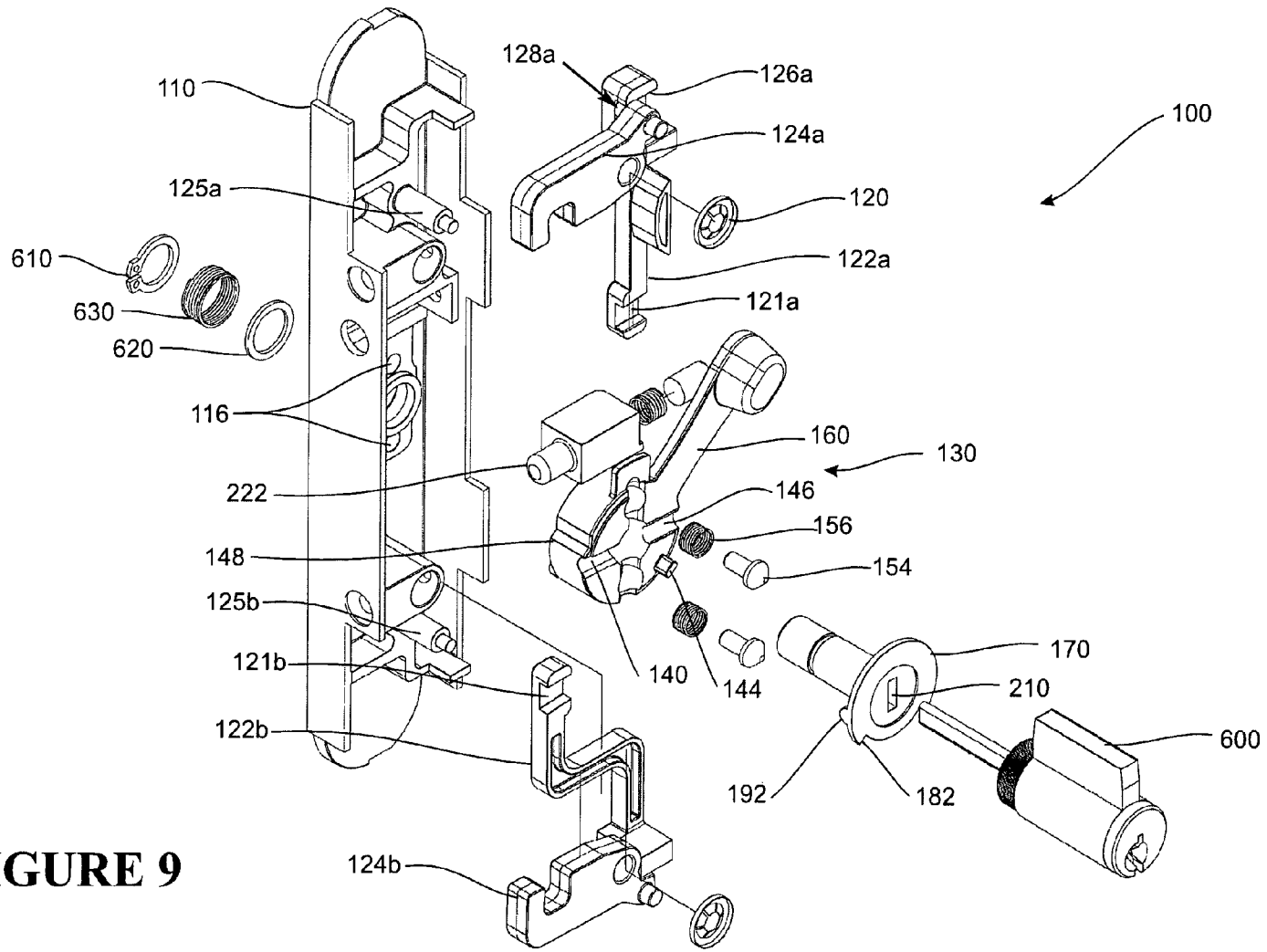
FIG. 9: shows an exploded assembly view of a second embodiment of a lock.

The locking assembly further comprises an engaging member 170. It may be configured generally in the form of a washer as shown in FIGS. 3-6. In the embodiment shown in FIGS. 3-6, both the base member 140 and the engaging member 170 abut each other, and are coaxial and pivotally moveable relative to the housing 110. The engaging member 170 is engageable to a shaft 200 (as shown in FIG. 3) by means of an aperture 172 in the engaging member 170. The aperture may have a pair of flat edges 174 which complement the shape of the shaft 200 which has opposed flat sides 212. The aperture 172 is configured and adapted to be engageable with and moved by the shaft 200. The engaging member 170 can move axially along the shaft 200. The shaft 200 is in turn configured to engage with and be turned by an actuator in the form of a key barrel 600 by key barrel engagement formations 210 at each opposed end of the shaft 200. The key barrel engagement formations 210 are configured for engaging with a tongue of a key barrel 600. In this way the rotation of the shaft 200 can be driven by way of a key (not shown). The base member 140 has no such configuration or adaptation, and the key barrel has no direct driving effect on the rotational position of the base member 140. However, base member 140 and the engaging member 170 need not necessarily be two members. This is shown in FIG. 9, where the base member 140 and the engaging member 170 are integrally formed as a single member. In yet another embodiment (not shown), the base member 140 and the engaging member 170 may be separate members that are securely engaged with each other.

The engaging member 170 is held in position on the shaft 200 against the base member 140 by a circlip 610, and washer 620 arrangement (as shown in FIG. 9). Further, the engaging means 170 is moveable along the shaft 200, but biased against the base member 140 by a biasing means in the form of a spring 630 disposed around the shaft 200 between the engaging member 170 and the washer 620. The effect of the circlip 610, washer 620 and spring 630 holding the engaging member 170 onto the shaft 200 is that the engaging member 170 is allowed a small amount of vertical play along the shaft 200 in a direction parallel to axis X-X.

The engaging member 170 is engageable with the base member 140 to move the base member 140 between its first position and second position by way of lost-motion. This may be provided by lost motion formation 180 on the engaging member 170, in a manner to establish lost motion movement between the engaging member 170 and the base member 140. The lost motion formation 180 comprises a recess 182 in the periphery of the engaging member 170, having a driving surface such as on edge 184 *a&b* on either side of the recess 182. As the engaging formation 170 is pivoted by the key barrel 600, its movement will not cause the base member 140 to move until one of the edges 184 *a&b* of recess 182 encounters an engaging formation in the form of a second lug formation 144. Only then will pivotal movement of the engaging member 170 cause the base member 140 to pivot with it.

Figure 5:
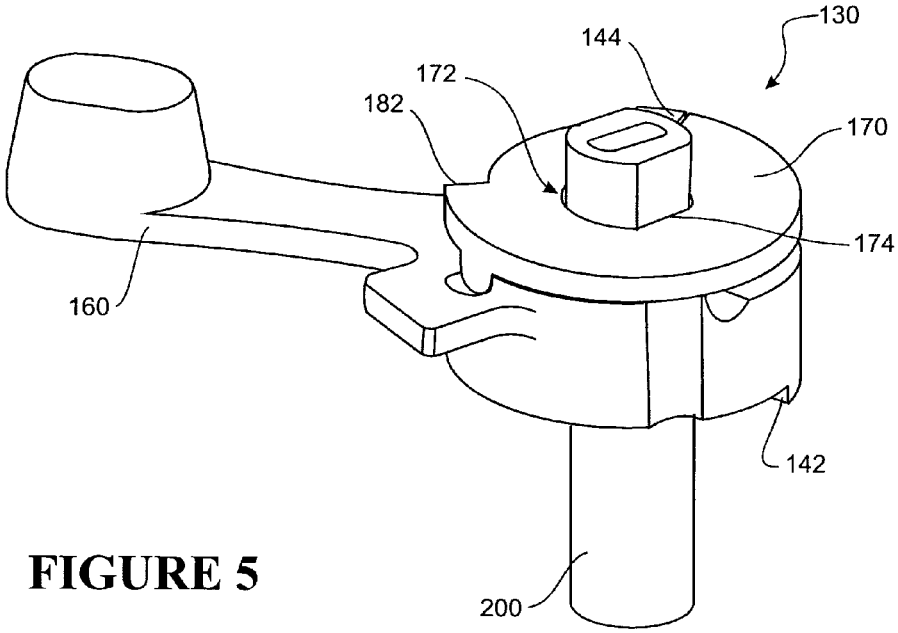
FIG. 5: shows a close up perspective view of the manual lever and locking assembly of a lock, showing the base member and engaging member in an engaged configuration.
Figure 7:
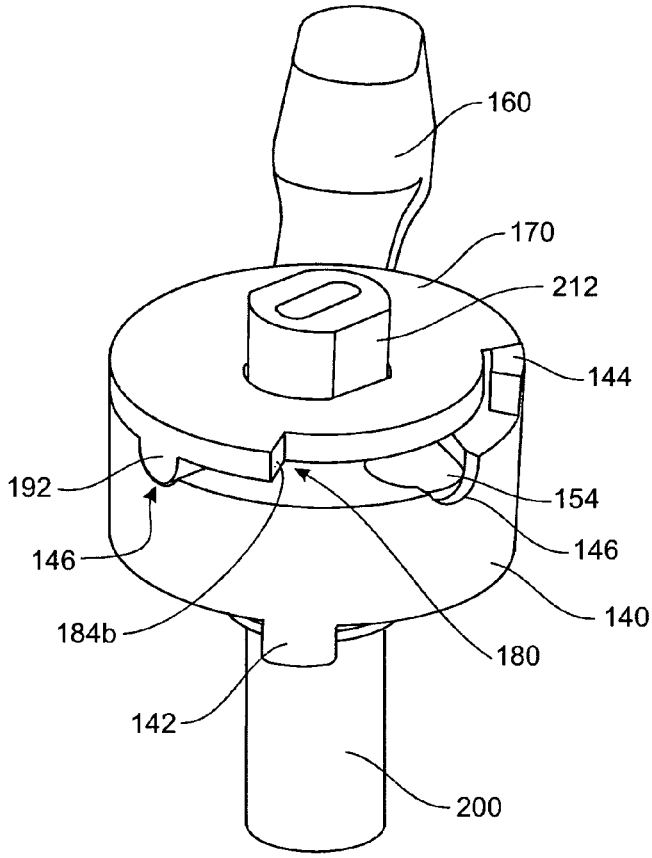
FIG. 7: shows a close up perspective view of the manual lever and locking assembly of a lock, showing the base member and engaging member in an unengaged configuration.
Figure 8:
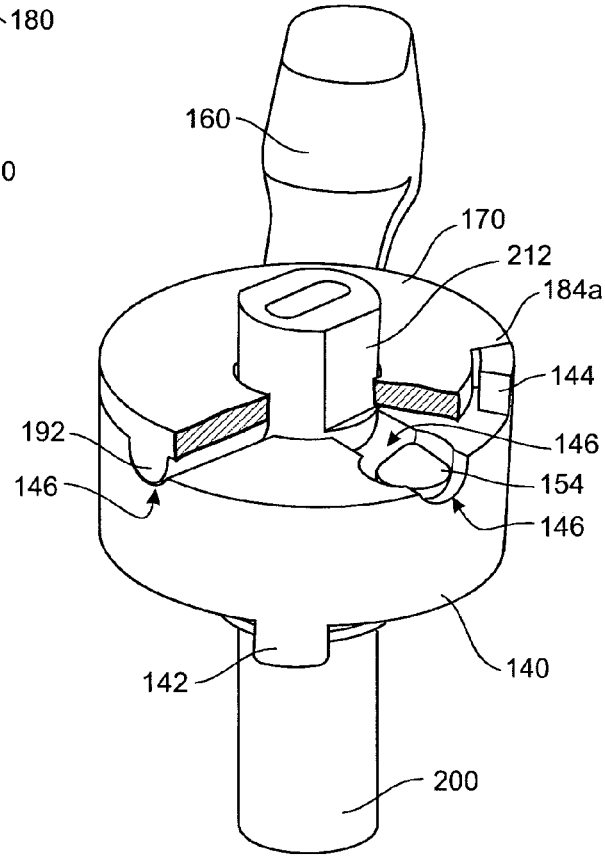
FIG. 8: shows a cutaway close up perspective view of the manual lever and locking assembly of a lock, showing the base member and engaging member in an unengaged configuration.

Whilst the second lug formation 144 has not been engaged by one of the edges 184 *a&b*, there will be relative movement between the engaging member 170 and the base member 140. This relative movement between the engaging member 170 and the base member 140 allows movement between an engaged configuration (as shown in FIGS. 5 and 6), and an unengaged configuration (as shown in FIGS. 3,4,7 an 8) relative to each other.

As may be seen in FIGS. 3-8, the engaging member 170 further includes actuating formations 190 in the form of a pair of diametrically opposed cam formations 192. These may project axially from the generally washer-like configuration of the engaging member 170.

When the engaging member 170 and the base member 140 are in an unengaged configuration, then the cam formations 192 are not in alignment with the locking pins 154 of the locking arrangement 150, and the locking pins 154 are biased (by springs 156) to their free position, allowing pivotal movement of the base member 140. As the engaging member 170 and the base member 140 are pivoted with respect to each other to their engaged configuration, the cam formation 192 can become aligned with the locking pins 154, pushing them against their bias. When aligned, the locking pins can be pushed into their locking position into the holes 116 in the housing 110 below the base member 140. In this engaged configuration, the base member 140 is prevented from pivotal movement by the locking pins 154.

As the engaging member 170 and the base member 140 pivot relative to each other and then reach the end of their range of relative movement (i.e. the range of movement between which the second lug formation 144 is moving between the edges 184 *a*&*b* of the recess 182), the cam formation 192 each move between two locating channels 146*a* &*b* in the base member 140. These locating channels 146 *a*&*b* allow each of the cam formations 192 to snap firmly into position at the end of its range of movement.

Locating channel 146*a* includes a pair of locking pins 154 disposed in alignment along their length. Locating channel 146*b* is at the opposed end of the range of movement of the cam formations 192. When the engaging member 170 and the base member 140 are in their unengaged configuration, and the cam formations 192 are firmly engaged in locating channel 146*b*, then when the key barrel 600 is turned by a user via a key to lock the lock 100, the key barrel 600 will cause the engaging member 170 to turn.

However, because the engaging member 170 is held firmly against the base member 140 by the spring 630, with the cam formations 192 engaged in the locating channel 146*b*, the movement of the engaging member 170 will first cause movement of the base member 140 from its second to its first position, since this action provides less resistance to movement. Once the base member 140 is in its first position, continued turning of the key barrel 600 will resulting the cam formations 192 moving out of the locating channel 146*b* against the direction of bias of the spring 630, to allow relative lost motion movement between the engaging member 170 and the base member 140, until the engaging member 170 and the base member 140 are in their engaged configuration.

In the engaged configuration the cam formations 192 are aligned with locating channel 146*a*, and are pushing locating pins 154 down into holes 116 to deadlock the base member 140. In this way, initial turning movement of the key barrel 600 causes the latch linkage 120 to move to its locked position, and further turning movement of the key barrel 600 causes the deadlocking of the lock against any form of unlocking except by way of turning the key barrel 600 in the opposite direction.

It will be appreciated that locating channel 146*b* is more effective at locating the cam formations 192 than locating channel 146*a*, since the cam formations 192 tend to engage with the locking pins 154 when it moves into locating channel 146*a*, and hence can be more easily moved out of locating channel 146*a*.

Movement of the engaging member 170 by a key barrel 600 to unlock the lock 100 first causes relative movement of the engaging member 170 and base member 120 to their unengaged configuration. This is because the cam formations 192 are easily moved out of locating channel 146*a*. This allows the locking pins 154 be pushed out of the holes 116 by their associated springs, and hence movement of the locking arrangement 150 to its free position. Further turning of the key barrel 600 causes movement of the base member 140 to its second position, thereby causing the latch linkage 120 to move to its unlocked position. In this way, the initial turning of the key barrel 600 will remove the deadlocking effect of the locking pins 154, and further turning of the key barrel 600 will cause the latch members 124 to disengage from the strike, allowing the door or window (not shown) on which it is mounted to be opened.

It will be appreciated that where the base member 140 is not in its first position in which the locking arrangement 150 is not actuatable to its locking position (i.e. the locking pins 154 are not aligned with the holes 116), then the locking pins 154 cannot be moved to their locking position. The engaging member 170 may in such condition still be in a position to have its cam formations 192 engaged with the locking pins 154. The locking pins 154, however, cannot be driven by the cam formations to move to their locking position until they become aligned with the holes 116 in the housing 110.

In order to lock the lock 100 from an unlocked position, the key barrel 600 is turned by a person. The engaging member 170 and base member 140 will start off from an unengaged configuration, with the cam formations 192 located in locating channel 146*b* that are not associated with a pair of locking pins 154. Pivoting of the shaft 200 causes pivoting of the engaging member 170 about axis X-X. As the engaging member 170 pivots relative to the base member 140, a period of lost motion will occur in which the cam formations 192 are moving towards a pair of locating channels 146 associated with a pair of locking pins 154.

As the engaging member 170 and the base member 140 reach the end of their range of relative movement, the cam formations 192 will snap into the locating channels 146 that are associated with the locking pins 154, and act to push the locking pins 154 down. Where the base member 140 has not moved in its first position, the locking pins 154 will not be pushed into the holes 116 in the housing 110, since there are no holes 116 in alignment for them to move into. In this case, the base member 140 is not yet deadlocked to prevent its pivotal movement. As the key barrel 600 and shaft 200 is turned further, the cam formation 192 rides up onto the tapered to surfaces of the locking pins 154. The combined force of the cam formation 192 acting on the tapered surface of the locking pins 154 and the edge 184*b* acting against the second lug formation 144 pushes the base member 140 into from its second position into its first position. Once the base member 140 is in its first position, the locking pins 154 will align with the holes 116 in the housing 110, and deadlock the base member 140 against pivotal movement. The base member 140 may be unlocked by reversing the procedure described above.

Alternately, the base member 140 may be moved between its second position and its first position by operation of the manual lever 160. This will cause the latch linkage 120 to move between the locked position and unlocked position. Once the base member 140 has been moved to its first position (and the latch linkage 120 is in the locked position), it can be deadlocked by pivoting the key barrel 600 until cam formations 192 push the locking pins 154 into the holes 116. This results in a deadlocked lock 100 in which the manual lever 160 is not operable to move the latch linkage 120 anymore. This procedure can be reversed to unlock the lock 100.

In a preferred embodiment, the lock further comprises an anti-slam mechanism 220 for preventing movement of the latch linkage 120 from an unlocked position to a locked position unless the housing 110 is in close proximity to a door frame or strike. The anti-slam mechanism 220 comprises a depressable member 222 moveable between an extended position (as shown in FIG. 1) and a depressed position (not shown). The anti-slam mechanism 220 further includes a locking formation 224 which is engageable with a proximity locking formation, preferably in the form of an axially aligned slot 148 in the cylindrical outer periphery of the base member 140. The depressable member 222 is biased to extend from the housing 110, thereby pushing the locking formation 224 into engagement with the base member 140.

When the latch linkage 120 is in the unlocked position, the base member will be in its second position, and the locking formation 224 is received into the slot 148 in the base member 140. In this position, the base member 140 is prevented from moving to its second position (which would mean that the latch linkage moves to its locked position and the latch members 124 *a*&*b* extend from the housing 110) unless the depressable member 222 is depressed by the proximity of the strike to the housing 110. In this way, a door having a lock 100 cannot be closed with the latch members 124 *a*&*b* extending from the housing, thereby potentially causing damage to the door frame (not shown) and/or the latch members 124.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention. As an illustration, it will be appreciated that similar effects may be obtained by moving parts moving in a linear-type motion, as opposed to rotational or pivoting-type motion, or by a combination of both, or using a known mechanism capable of translating linear motion to rotational motion and vice versa.

The invention claimed is:

1. A lock suitable for a sliding barrier, said lock comprising
a) a housing
b) a latch linkage moveable between
a locked position in which at least part of the latch linkage extends from the housing for engagement with a strike, and
an unlocked position in which the latch linkage is at least partly retracted into the housing; and
c) a locking assembly comprising
i) a moveable base member, said base member being coupled to the latch linkage to move between
a first position in which the latch linkage is in a locked position, and
a second position in which the latch linkage is in its unlocked position;
ii) a locking arrangement configured and adapted to be actuated for movement between
a locking position when the base member is in its first position, and in which the base member is prevented from moving relative the housing, and
a free position wherein the locking arrangement does not prevent movement of the base member;
iii) a manual lever associated with the base member, said lever being manually operable by a user to move the base member between its first position and second position, thereby moving the latch linkage between its locked and unlocked position respectively; and
iv) an engaging member,
said engaging member configured and adapted to be movable by at least one actuator;
said engaging member being associated with the base member to move relative to it in a lost motion manner to move the base member between its first position and second position,
wherein the lost motion movement by the engaging member relative to the base member is between
an engaged configuration, and
an unengaged configuration;
said engaging member including an actuating formation which is configured and adapted to engage with the locking arrangement to actuate it to its locking position when the configuration of the base member and the engaging member is in an engaged configuration and the base member is in its first position, thereby deadlocking the base member against movement by operation of the manual lever;
wherein the base member and engaging member are pivotably movable relative to the housing, and
wherein the engaging member is movable in a direction parallel to its axis of rotation and biased towards the base member to engage with
at least the base member when the engaging member and the base member are in their unengaged configuration, and to engage with
at least the locking arrangement when the engaging member and the base member are in their engaged configuration, to thereby deadlock the base member.

2. A lock according to claim 1, wherein the movement of the engaging member said actuator, to lock the latch linkage, first causes movement of the base member to its first position before causing relative movement between the engaging member and the base member to move to their engaged configuration.

3. A lock according to claim 2, wherein the effect of the movement of the engaging member by an actuator, first causing movement of the base member to its first position before causing relative movement between the engaging member and the base member, is caused by the actuating formation engaging with a locating formation on the base member to hold the base member and the engaging member together.

4. A lock according to dam 1, wherein the movement of the engaging member by said actuator, to unlock the latch linkage, first causes relative movement of the engaging member and base member to an unengaged configuration to allow movement of the locking arrangement to its free position before causing movement of the base member to its second position.

5. A lock according to claim 4, wherein the effect of the movement of the engaging member by said actuator to unlock the latch linkage, by first causing relative movement of the engaging member and base member to their unengaged configuration to allow movement of the locking arrangement to its free position before causing movement of the base member to its second position, is caused by relative movement between the base member and the engaging member to cause the actuating formation to disengage with the locking arrangement before moving into engagement with a locating formation, after which the base member and engaging member are held together to cause movement of the base member to its second position.

6. A lock according to claim 1, wherein the lost motion movement between the engaging member and the base member is provided by a lost-motion formation.

7. A lock according to claim 6, wherein the lost motion formation is on the engaging member.

8. A lock according to claim 6, wherein the lost motion formation is engageable with an engaging formation on the base member in a manner to induce lost motion movement.

9. A lock according to claim 1, wherein the base member is generally cylindrical in shape.

10. A lock according to claim 1, wherein the base member is pivotally moveable between its first position and second position.

11. A lock according to claim 1, wherein both the base member and the engaging member are pivotally moveable relative to the housing.

12. A lock according to claim 1, wherein the lock includes a shaft.

13. A lock according to claim 12, wherein the shaft extends through the housing.

14. A lock according to claim 12, wherein the shaft is configured and adapted to be engaged with and rotated by said actuator.

15. A lock according to claim 12, wherein the engaging member is axially moveable along the shaft.

16. A lock according to claim 12, wherein the engaging member is biased towards the base member by a biasing means.

17. A lock according to cam 16, wherein the biasing means is a spring.

18. A lock according to claim 17, wherein the spring is located on the shaft by a circlip and washer arrangement.

19. A lock according to claim 12, wherein the base member and engaging member are mounted on the shaft.

20. A lock according to claim 19, wherein the base member is rotatably mounted on the shaft.

21. A lock according to claim 19, wherein the engaging member is mounted on the shaft hi a non-pivotable fashion to rotate with the shaft.

22. A lock according to claim 21, wherein the engaging member is coaxial with, and biased towards an end of the base member adjacent the engaging formation.

23. A lock according to claim 21, wherein the engaging member is coaxial with, and biased into abutment with an end of the base member adjacent the engaging formation.

24. A lock according to claim 1, wherein the engaging member comprises a) a shaft engaging formation, b) a lost motion formation, and c) an actuating formation.

25. A lock according claim 24, wherein the shaft engaging formation is one or more selected from an aperture and recess.

26. A lock according to claim 25, wherein the aperture or recess includes at least one flat side.

27. A lock according to claim 1, wherein the engaging member is generally disc-shaped.

28. A lock according to claim 27, wherein the engaging member is generally configured in the form of a washer.

29. A lock according to claim 1, wherein the actuating formation is in the form of cam formations extending from the washer.

30. A lock according to claim 1, wherein the lost motion formation is a recess in the engaging member.

31. A lock according to claim 1, wherein the latch linkage comprises a) at least one sliding member coupled to the base member b) at least one latch member coupled to the sliding member to be pivoted by sliding movement of the sliding member to move pivotally between i) locked position and ii) an unlocked position.

32. A lock according to claim 31, wherein the latch linkage comprises plurality of sliding members and a plurality of latch members.

33. A lock according to claim 1, wherein the locking arrangement includes a) a locking pin slidingly receivable into a passage in the base member, said locking pin being slidingly moveable between i) a locking position in which it extends from the base member into locking formations on the housing, to prevent movement of the base member, and ii) a free position, in which the locking pin is retracted from the locking formations, to allow movement of the base member.

34. A lock according to cairn 33, wherein the longitudinal axis of the locking pin is oriented substantially parallel to the axis of the base member.

35. A lock according to claim 1, wherein the lock includes an anti-slam mechanism for preventing movement of the latch linkage from an unlocked position to a locked position unless the housing is in close proximity to a door frame.

36. A lock according to claim 35, wherein the anti-slam mechanism acts on the base member to prevent movement of the latch linkage from an unlocked position to a locked position unless the housing is in close proximity to a door frame.

37. A lock according to claim 35, wherein the anti-slam mechanism comprises a) a depressible member moveable between i) an extended position and ii) a depressed position, and b) a locking formation which is engageable with the base member when the depressible member is in its extended position to prevent movement of the base member.

38. A lock according to claim 1, wherein the engaging member is engageable for movement by a plurality of said actuators.

39. A lock according to claim 1, wherein the engaging member is engageable for movement by a pair of said actuators, each one located at opposing sides of the housing.

40. A lock according to claim 39, wherein each of the pair of said actuators is engageable with the shaft, which in turn engages the engaging member to rotate it.

41. A lock according to claim 1, wherein at least one of actuators are key barrels.

42. A lock according to claim 1, wherein the housing is adapted to be secured to an outer major face of a sliding barrier.

43. A lock according to any of claim 42, wherein the latch member is configured to pivot outwardly from the housing about an axis perpendicular to the major face of the sliding barrier.

44. A lock arrangement for a sliding barrier, said lock arrangement comprising a) a housing b) a latch linkage moveable between a locked position in which at least part of the latch linkage extends from the housing for engagement with a strike, and an unlocked position in which the latch linkage is at least partly retracted into the housing; and c) a locking assembly comprising i) a manual lever extending from a moveable base member, said base member being coupled to the latch linkage to move between a first position in which the latch linkage is in a locked position, and a second position in which the latch linkage is in its unlocked position, a locking arrangement configured and adapted to be prevent movement of the latching mechanism by the manual lever ii) said manual lever being manually operable by a user to move the base member between its first position and second position, thereby moving the latch linkage between its locked and unlocked position respectively; and iii) an engaging member, said engaging member movable by at least one actuator;

said engaging member being moveable relative to the base member between an engaged configuration, and an unengaged configuration;

wherein movement of the latch linkage by the manual lever is prevented by the locking arrangement when the engaging member and base member are in their engaged configuration;

wherein the base member and engaging member are pivotably movable relative to the housing in a coaxial manner, and wherein the engaging member is movable in a direction parallel to its axis of rotation and biased towards the base member to engage with at least the base member when the engaging member and the base member are in their unengaged configuration, and to engage with at least the locking arrangement when the engaging member and the base member are in their engaged configuration, to thereby deadlock the base member.

45. A lock arrangement according to claim 44, wherein the movement of the latch linkage by the manual lever is rigidly locked when the engaging member and base member are in theft engaged configuration.

* * * * *

UNITED STATES PATENT AND TRADEMARK OFFICE

CERTIFICATE OF CORRECTION

PATENT NO. : 8,631,670 B2
APPLICATION NO. : 13/139001
DATED : January 21, 2014
INVENTOR(S) : Edward Norton Sieglaar et al.

It is certified that error appears in the above-identified patent and that said Letters Patent is hereby corrected as shown below:

In the Claims
Column 13, claim 21, line 39: replace the word "hi" with the word --in--
Column 16, claim 45, line 48: replace the word "theft" with the word --their--

Signed and Sealed this
Twenty-ninth Day of April, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,631,670 B2
APPLICATION NO. : 13/139001
DATED : January 21, 2014
INVENTOR(S) : Sieglaar et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 243 days.

Signed and Sealed this
Twenty-second Day of September, 2015

Michelle K. Lee

Michelle K. Lee
*Director of the United States Patent and Trademark Office*